US010458367B2

(12) United States Patent
Kikuchi et al.

(10) Patent No.: US 10,458,367 B2
(45) Date of Patent: Oct. 29, 2019

(54) EVAPORATED FUEL TREATING DEVICE

(71) Applicant: Toyota Jidosha Kabushiki Kaisha, Toyota-shi, Aichi-ken (JP)

(72) Inventors: Kazuki Kikuchi, Mishima (JP); Hiroshi Otsuki, Gotemba (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/951,574

(22) Filed: Apr. 12, 2018

(65) Prior Publication Data

US 2018/0298851 A1 Oct. 18, 2018

(30) Foreign Application Priority Data

Apr. 17, 2017 (JP) ..... 2017-081548

(51) Int. Cl.
*F02M 25/08* (2006.01)

(52) U.S. Cl.
CPC ..... *F02M 25/089* (2013.01); *F02M 25/0836* (2013.01); *F02M 25/0872* (2013.01); *F02M 2025/0881* (2013.01)

(58) Field of Classification Search
CPC ..... F02M 25/089; F02M 25/0872; F02M 25/0836; F02M 2025/0881
See application file for complete search history.

(56) References Cited

U.S. PATENT DOCUMENTS

2008/0141984 A1* 6/2008 Haga ..... C01B 3/323 123/525
2008/0230017 A1* 9/2008 Kobayashi ..... B01J 23/60 123/3
2015/0337775 A1* 11/2015 Dudar ..... F02M 25/089 123/520

FOREIGN PATENT DOCUMENTS

JP 2015117599 A 6/2015

* cited by examiner

*Primary Examiner* — Xiao En Mo
(74) *Attorney, Agent, or Firm* — Dinsmore & Shohl LLP

(57) ABSTRACT

An evaporated fuel treating device includes a fuel tank, a canister containing a fuel adsorbent, a vent pipe, a purge pipe, a purge valve, and a reforming catalyst. The fuel adsorbent captures evaporated fuel that is generated in the fuel tank. The evaporated fuel flows into the canister through the vent pipe. The fuel captured in the canister flows into an intake passage of an engine through the purge pipe. The purge valve is interposed in the purge pipe and opens when the captured fuel is introduced into the intake passage. The reforming catalyst is disposed in a space where the reforming catalyst comes into contact with the evaporated fuel that has not reached the canister. The reforming catalyst is configured to promote a chemical change from unsaturated hydrocarbon to alcohol.

3 Claims, 3 Drawing Sheets

EVAPORATED FUEL TREATING DEVICE

CROSS-REFERENCE TO RELATED APPLICATIONS

This application claims priority to Japanese Patent Application No. 2017-081548 filed on Apr. 17, 2017, which is incorporated herein by reference in its entirety including the specification, drawings and abstract.

BACKGROUND

1. Technical Field

The disclosure relates to an evaporated fuel treating device that captures evaporated fuel generated in a fuel tank and introduces the captured evaporated fuel into an intake passage of an internal combustion engine.

2. Description of Related Art

An engine (hereinafter, also referred to as an "engine of the related art") that is provided with a canister in order to avoid evaporated fuel generated in a fuel tank storing fuel that is supplied to an internal combustion engine (hereinafter also simply referred to as an "engine") being discharged into the atmosphere is known (refer to, for example, Japanese Unexamined Patent Application Publication No. 2015-117599 (JP 2015-117599 A)). The canister contains a fuel adsorbent, and the fuel adsorbent captures the evaporated fuel introduced into the canister from the fuel tank.

A purge valve is interposed in a purge pipe that makes an intake passage of the engine of the related art communicate with the canister. When the purge valve is opened, an air current (hereinafter also referred to as a "purge air current") flowing toward the intake passage from the canister is generated due to a pressure drop (that is, intake negative pressure) in the intake passage, which is generated in an intake stroke of the engine of the related art. Due to the purge air current, the fuel captured by the fuel adsorbent is desorbed from the fuel adsorbent and the desorbed fuel is introduced into the intake passage. The fuel introduced into the intake passage burns in a combustion chamber together with the fuel injected from a fuel injection valve. The processing of introducing the fuel captured by the fuel adsorbent into the intake passage of the engine by opening the purge valve is also hereinafter referred to as "purge processing".

SUMMARY

Incidentally, a hybrid vehicle that is equipped with an electric motor as a drive power source in addition to an engine is in widespread use. In the hybrid vehicle, there is a case where solely the electric motor generates the drive power (drive torque) that is needed for traveling and the operation of the engine is stopped. In this case, it is not possible to execute the purge processing needing the intake negative pressure. In other words, in the hybrid vehicle, the opportunity in which the purge processing can be executed is reduced compared to a "vehicle in which the drive torque is generated solely by the engine".

In a case where the opportunity in which the purge processing can be executed is reduced, a possibility that a state (hereinafter also referred to as a "saturated state") where the amount of evaporated fuel (captured fuel amount) captured by the canister increases and eventually reaches the upper limit (hereinafter also referred to as a "capture upper limit amount") of the fuel amount that can be captured by the canister may occur becomes high. When the canister is in the saturated state and the evaporated fuel further flows into the canister, a phenomenon in which the evaporated fuel is discharged to the atmosphere without being captured by the canister (hereinafter also referred to as an "excessive evaporated fuel emission phenomenon") occurs.

The excessive evaporated fuel emission phenomenon according to a decrease in the opportunity in which the purge processing can be executed may also occur, for example, in a vehicle (that is, a vehicle having a start-stop function) in which an operation of an engine is temporarily stopped when a vehicle has stopped traveling.

Even when a decrease in the opportunity in which the purge processing can be executed does not occur, when the amount of fuel flowing into the intake passage during the execution of the purge processing decreases, a possibility that the excessive evaporated fuel emission phenomenon may occur increases. The decrease in the amount of fuel flowing into the intake passage during the execution of the purge processing is caused by, for example, a decrease in the intake negative pressure (that is, a decrease in the magnitude of the difference between the pressure in the intake passage in the intake stroke and the atmospheric pressure). The decrease in the intake negative pressure occurs, for example, in a case where an engine adopts the Atkinson cycle and a case where an engine is provided with a supercharger.

The reason why the amount of fuel flowing into the intake passage during the execution of the purge processing decreases due to the decrease in the intake negative pressure will be described. The fuel captured in the canister is desorbed by the purge air current that is generated during the execution of the purge processing. When the intake negative pressure is relatively small (that is, the magnitude of the difference between the pressure in the intake passage and the atmospheric pressure is relatively small), the flow velocity of the purge air current becomes small compared to when the intake negative pressure is relatively large. As a result, the amount of fuel that is desorbed from the canister decreases, and thus the amount of fuel flowing into the intake passage during the execution of the purge processing decreases.

There is a possibility that the occurrence of the excessive evaporated fuel emission phenomenon may be avoided by an increase in the capture upper limit amount according to an increase in the size of the canister. However, there is a case where an increase in the size of the canister cannot be realized due to restrictions in the vehicle design, such as securement of an installation position and an increase in production costs.

The disclosure provides an evaporated fuel treating device capable of further reducing a possibility of occurrence of an excessive evaporated fuel emission phenomenon without increasing the size of a canister.

An aspect of the disclosure relates to an evaporated fuel treating device. The evaporated fuel treating device includes a fuel tank, a canister, a vent pipe, a purge pipe, a purge valve, and a reforming catalyst. The fuel tank stores fuel, in a liquid state, to be supplied to an internal combustion engine, in a liquid state. The canister contains a fuel adsorbent. The fuel adsorbent is configured to capture evaporated fuel that is generated due to vaporization of the fuel stored in the fuel tank. The evaporated fuel in the fuel tank flows into the canister though the vent pipe. The fuel captured in the canister flows into an intake passage of the internal combustion engine through the purge pipe. The purge valve is interposed in the purge pipe and configured to open when the captured fuel is introduced into the intake passage. The reforming catalyst is disposed in a space in which the reforming catalyst comes into contact with the evaporated fuel that is generated in the fuel tank and that has not reached the canister. The reforming catalyst is configured to promote a chemical change from unsaturated hydrocarbon contained in the evaporated fuel to alcohol.

The reforming catalyst is composed of, for example, mesoporous silica as a carrier and platinum (Pt) supported on the carrier. The carrier that is used for the reforming catalyst may be aluminum oxide ($Al_2O_3$), silicon dioxide ($SiO_2$), zirconia ($ZrO_2$), titanium oxide ($TiO_2$), or the like. The substance that is supported on the carrier may be palladium (Pd), gold (Au), silver (Ag), or the like.

When the evaporated fuel comes into contact with the reforming catalyst, the hydration reaction of the unsaturated hydrocarbon (specifically, olefin, aromatics, or the like) contained in the evaporated fuel is promoted. As a result, alcohol is produced. As a result of the hydration reaction (that is, reforming), (a) the amount of the evaporated fuel flowing into the canister decreases, (b) the capture upper limit amount increases, and (c) desorption of the fuel captured in the canister becomes easy.

Describing the above (a), some of the alcohol generated by the reforming of the evaporated fuel comes into contact with the liquid fuel in the fuel tank and is dissolved therein. That is, the concentration of alcohol in the liquid fuel increases due to the reforming of the evaporated fuel. The saturated vapor pressure of alcohol generated by the reforming of the evaporated fuel is lower than the saturated vapor pressure of unsaturated hydrocarbon that is a substance before the reforming. That is, alcohol generated by the reforming of the evaporated fuel has a higher boiling point than that of unsaturated hydrocarbon that is a substance before the reforming. For this reason, the amount of evaporating fuel decreases due to an increase in the concentration of alcohol in the liquid fuel. Therefore, the amount of the evaporated fuel flowing into the canister decreases due to the reforming into alcohol.

Describing the above (b), when alkane, olefin, and the like contained in the evaporated fuel are adsorbed to the fuel adsorbent contained in the canister, a mono-molecular layer is formed due to chemical adsorption (refer to the left side of FIG. 2). On the other hand, alcohol generated by the reforming of the evaporated fuel is adsorbed to the fuel adsorbent by chemical adsorption and alcohol molecules are physically adsorbed to each other to form a multi-molecular layer (refer to the right side of FIG. 2).

When the concentration of the "substance (in this case, alcohol) forming the multi-molecular layer at the time of adsorption to the fuel adsorbent" due to the reforming of the evaporated fuel increases, the number of molecules that are adsorbed per unit surface area of the fuel adsorbent increases. For this reason, the capture upper limit amount increases due to the reforming into alcohol.

Describing the above (c), the adsorption power of physical adsorption is weaker than the adsorption power of chemical adsorption, and therefore, the multi-molecular layer formed by the physical adsorption is easily desorbed by the purge air current, compared to the mono-molecular layer formed by the chemical adsorption. For this reason, the fuel captured in the canister can be easily desorbed by the reforming into alcohol.

Therefore, a possibility that the captured fuel amount may reach the capture upper limit amount can be further reduced due to the reforming of the evaporated fuel into alcohol. Therefore, according to the aspect of the disclosure, a possibility that the occurrence of the excessive evaporated fuel emission phenomenon may be avoided without increasing the size of the canister becomes high.

In the evaporated fuel treating device, the reforming catalyst may be disposed in the space isolated from the fuel stored in the fuel tank by a cutoff valve. The cutoff valve may be configured to block a flow of liquid and allow a flow of gas.

The cutoff valve is configured using, for example, a float valve. Direct contact of the reforming catalyst with the liquid fuel in the fuel tank is avoided by the cutoff valve. When the reforming catalyst comes into direct contact with the liquid fuel, not only the evaporated fuel but also the liquid fuel is reformed into alcohol. As a result, there is a possibility that the concentration of alcohol in the liquid fuel becomes higher than needed.

The amount of heat generated during combustion is further reduced by the reforming from unsaturated hydrocarbon into alcohol, and therefore, when the concentration of alcohol in the liquid fuel becomes higher than needed, there is a possibility that the decrease amount of torque that is generated by the engine when the fuel is supplied to the engine and burned becomes larger. However, according to the aspect of the disclosure, while the evaporated fuel is reformed into alcohol, the reforming of the liquid fuel into alcohol is avoided, and thus the increase in the concentration of alcohol in the liquid fuel higher than needed is avoided.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
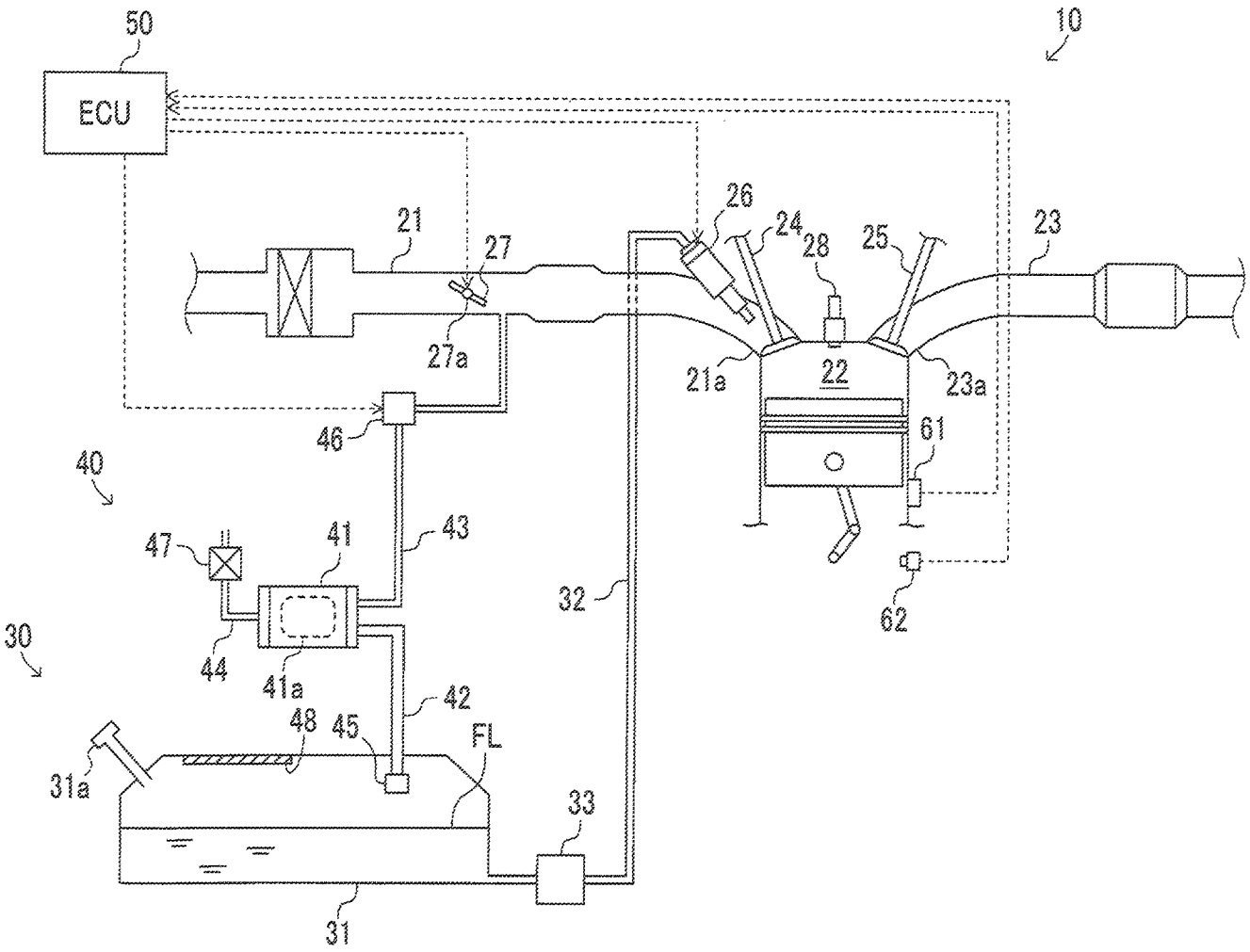
FIG. 1 is a schematic diagram of an evaporated fuel treating device according to an embodiment of the disclosure and an engine to which the evaporated fuel treating device is applied.

Hereinafter, an evaporated fuel treating device according to an embodiment of the disclosure will be described with reference to the drawings. The configuration of the evaporated fuel treating device is shown in FIG. 1. The evaporated fuel treating device is applied to a multi-cylinder, spark ignition, and gasoline fuel injection type engine 10. The engine 10 is mounted as a drive power source on a vehicle (hereinafter also referred to as "the present vehicle") (not shown). The present vehicle is also provided with an electric motor (not shown) as a drive power source in addition to the engine 10. That is, the present vehicle is a hybrid vehicle.

The engine 10 includes an intake passage 21 that includes an intake port 21*a*, a combustion chamber 22, an exhaust passage 23 that includes an exhaust port 23*a*, an intake valve 24, an exhaust valve 25, a fuel injection valve 26, a throttle valve 27 that is provided with an actuator 27*a*, and a spark plug 28.

The intake valve 24 is disposed in a cylinder head portion and is driven by an intake camshaft (not shown) to open and close "a communication portion between the intake port 21*a* and the combustion chamber 22". The exhaust valve 25 is disposed in the cylinder head portion and is driven by an exhaust camshaft (not shown) to open and close "a communication portion between the exhaust port 23*a* and the combustion chamber 22".

The fuel injection valve 26 is disposed in the intake port 21*a*. The fuel injection valve 26 is made to inject fuel into the intake port 21*a* according to an instruction from an electronic control unit (ECU) 50 (described later). The fuel injected from the fuel injection valve 26 is supplied to the combustion chamber 22 together with "air that is introduced into the combustion chamber 22 through the intake passage 21".

The throttle valve 27 is disposed in the intake passage 21. The throttle valve 27 is opened and closed by the actuator 27*a* responding to an instruction from the ECU 50. That is, the degree of opening of the throttle valve 27 is adjusted by the actuator 27*a*, and thus the amount of air flowing into the combustion chamber 22 is adjusted.

The spark plug 28 is disposed in the cylinder head portion of the combustion chamber 22. The spark plug 28 ignites an air-fuel mixture in the combustion chamber 22 according to an instruction from the ECU 50.

Further, the present vehicle is provided with a fuel supply device 30 and an evaporated fuel treating device 40. The fuel supply device 30 includes a fuel tank 31 that is provided with a fuel supply port 31*a*, a fuel supply pipe 32, and a fuel pump 33.

The fuel tank 31 is a sealed container and stores fuel (the fuel is gasoline in the embodiment of the disclosure and may be alcohol-containing fuel) that is supplied to the fuel injection valve 26. The fuel in a liquid state (liquid fuel) stored in the fuel tank 31 is also hereinafter referred to as "fuel FL". The fuel supply pipe 32 makes the fuel tank 31 communicate with the fuel injection valve 26. The fuel pump 33 is interposed in the fuel supply pipe 32. The fuel pump 33 pressurizes the fuel that is supplied to the fuel injection valve 26.

The evaporated fuel treating device 40 includes a canister 41, a vent pipe 42, a purge pipe 43, an atmosphere pipe 44, a cutoff valve 45, a purge valve 46, an air filter 47, and a reforming catalyst 48.

The canister 41 is provided with a casing having a substantially cylindrical shape or a substantially rectangular parallelepiped shape, and a fuel adsorbent 41*a* contained in the casing. The fuel adsorbent 41*a* can capture (adsorb) evaporated fuel flowing into the canister 41. The fuel adsorbent 41*a* is composed of activated carbon. One end of each of the vent pipe 42, the purge pipe 43, and the atmosphere pipe 44 is connected to the canister 41. The end portion on the canister 41 side of each of the vent pipe 42 and the purge pipe 43 is provided at a position facing the end portion on the canister 41 side of the atmosphere pipe 44 with the fuel adsorbent 41*a* interposed therebetween. An operation of the canister 41 will be described later.

The vent pipe 42 makes the fuel tank 31 communicate with the canister 41. When the pressure in the fuel tank 31 is increased due to the evaporated fuel being generated by vaporization of some of the fuel FL, the evaporated fuel flows into the canister 41 through the vent pipe 42.

The purge pipe 43 makes the canister 41 communicate with the intake passage 21 (the position further on the downstream side than the throttle valve 27). The atmosphere pipe 44 is provided to introduce atmosphere into the canister 41.

The cutoff valve 45 is disposed at a protrusion portion in the fuel tank 31, which is one end of the vent pipe 42. The cutoff valve 45 includes a float valve and allows gas flow while hindering liquid flow. For this reason, the evaporated fuel can pass through the cutoff valve 45. However, inflow of the fuel FL from the fuel tank 31 to the canister 41 is blocked by the cutoff valve 45.

The purge valve 46 is interposed in the purge pipe 43. The purge valve 46 is an electromagnetic control valve and is opened according to an instruction from the ECU 50. The air filter 47 is interposed in the atmosphere pipe 44. The air filter 47 removes foreign matter in the atmosphere flowing into the canister 41 through the atmosphere pipe 44.

The reforming catalyst 48 is disposed on the inner upper surface of the fuel tank 31. That is, the reforming catalyst 48 is disposed in the fuel tank 31 and at a location where the fuel FL does not reach when the present vehicle is stationary. The reforming catalyst 48 includes mesoporous silica (porous silica, also referred to as MCM-41) as a carrier, and platinum (Pt) supported on the carrier. The action of the reforming catalyst 48 will be described later.

The ECU 50 is an electronic control unit that adjusts torque that is generated by the engine 10 and torque that is generated by the electric motor such that the acceleration of the present vehicle coincides with the needed acceleration of a driver. The ECU 50 is provided with a central processing unit (CPU), a read only memory (ROM), and a random access memory (RAM). The CPU sequentially executes a predetermined program (routine) to read data and perform an arithmetic operation, output of a result of the operation, and the like. The ROM stores the program that is executed by the CPU, a lookup table (map), and the like. The RAM temporarily stores data.

The ECU 50 is made to receive signals from a coolant temperature sensor 61 and a crank angle sensor 62.

The coolant temperature sensor 61 is disposed in a main body portion of the engine 10. The coolant temperature sensor 61 outputs a signal representing a coolant temperature THW that is the temperature of circulating coolant (not shown) for cooling the engine 10.

The crank angle sensor 62 generates a signal representing a rotational position of a crankshaft (not shown) of the engine 10. The ECU 50 calculates an engine speed NE of the engine 10, based on the signal from the crank angle sensor 62.

Operation of Evaporated Fuel Treating Device

The operation of the evaporated fuel treating device 40 will be described. When the pressure in the fuel tank 31 is increased due to an increase in the evaporated fuel in the fuel tank 31, the evaporated fuel flows from the fuel tank 31 into the canister 41 through the vent pipe 42 together with air in the fuel tank 31. The evaporated fuel flowing into the canister 41 is adsorbed to the fuel adsorbent 41*a*. That is, the canister 41 captures the evaporated fuel. On the other hand, air flowing into the canister 41 is discharged to the atmosphere through the atmosphere pipe 44.

When the amount of the evaporated fuel (the captured fuel amount) captured by the canister 41 continues to increase, eventually, the captured fuel amount reaches the upper limit (capture upper limit amount) of the amount of fuel that the canister 41 can capture. That is, the canister 41 enters a saturated state.

When the evaporated fuel further flows into the canister 41 when the canister 41 is in the saturated state, the evaporated fuel is discharged to the atmosphere through the atmosphere pipe 44 without being captured by the canister 41. That is, an excessive evaporated fuel emission phenomenon occurs.

Therefore, the ECU 50 executes purge processing in order to avoid the occurrence of the excessive evaporated fuel emission phenomenon. Specifically, when a predetermined purge processing execution condition is satisfied during the operation of the engine 10, the ECU 50 changes the purge valve 46 from a closed state to an open state. That is, the ECU 50 opens the purge valve 46.

In the embodiment of the disclosure, the purge processing execution condition is a condition that is satisfied when both of Condition 1 and Condition 2 described below are satisfied. Condition 1: the coolant temperature THW is higher than a predetermined threshold temperature THWth. Condition 2: the engine speed NE is larger than a predetermined threshold engine speed NEth.

When the purge processing is executed, air flowing into the canister 41 through the atmosphere pipe 44 flows into the intake passage 21 through the purge pipe 43 due to the negative pressure (that is, intake negative pressure) in the intake passage 21, which is generated in an intake stroke of the engine 10. That is, a purge air current is generated. At this time, the fuel adsorbed to the fuel adsorbent 41*a* desorbs and flows into the intake passage 21 together with the purge air current. The fuel contained in the purge air current burns in the combustion chamber 22 together with the fuel injected from the fuel injection valve 26. As a result, the captured fuel amount in the canister 41 decreases, and therefore, the occurrence of the excessive evaporated fuel emission phenomenon is avoided.

Action of Reforming Catalyst

During traveling of the present vehicle, there is a case where solely the electric motor generates drive power, while the operation of the engine 10 is stopped. For this reason, compared to a vehicle on which solely an engine is mounted as a drive power source, the opportunity of satisfying the Condition 2 decreases, and thus the opportunity in which the purge processing can be executed decreases. Even when the opportunity in which the purge processing can be executed decreases, in order to avoid the canister 41 entering the saturated state, the reforming catalyst 48 reforms some of the evaporated fuel in the fuel tank 31 into alcohol.

More specifically, due to the reforming catalyst 48, chemical combination (hydration reaction) of unsaturated hydrocarbon (specifically, olefin, aromatics, or the like) contained in the evaporated fuel in the fuel tank 31 and water vapor contained in air in the fuel tank 31 is promoted. The hydration reaction of olefin is expressed by the following formula (1). The hydration reaction of a non-conjugated double bond in a side chain of aromatics is expressed by the following formula (2). However, in the formula (2), "Ar" represents an aryl group. As understood from the formulas (1) and (2), the unsaturated hydrocarbon is reformed into alcohol due to the hydration reaction that is promoted by the reforming catalyst 48.

$$C_nH_{2n}+H_2O \rightarrow C_nH_{2n+1}OH \quad (1)$$

$$Ar—C_nH_{2n-1}+H_2O \rightarrow Ar—C_nH_{2n}—OH \quad (2)$$

Some of the evaporated fuel is reformed into alcohol, whereby the following effects (a) to (c) are obtained. (a): the amount of the evaporated fuel flowing into the canister 41 decreases. (b): the capture upper limit amount of the canister 41 increases. (c): desorption of the fuel captured in the canister 41 becomes easy.

First, the effect (a) will be described. Alcohol generated by the reforming has a higher boiling point than unsaturated hydrocarbon that is a substance before the reforming. For example, while the boiling point of 1-butene that is one type of unsaturated hydrocarbon contained in gasoline is −6.6° C., the boiling point of 1-butanol that is one type of alcohol generated by the reforming of 1-butene is 117.7° C.

Some of the alcohol generated by the reforming comes into contact with the fuel FL and is dissolved (liquefied) therein, and therefore, the concentration of alcohol in the fuel FL rises. As a result, the amount of evaporating fuel of the fuel FL decreases, and thus the amount of the evaporated fuel flowing into the canister 41 decreases.

Figure 2:
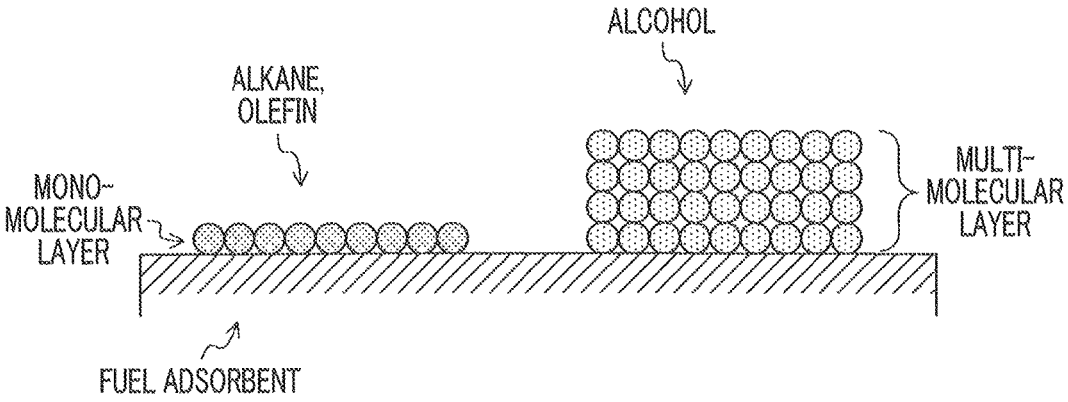
FIG. 2 is a schematic view showing a mono-molecular layer and a multi-molecular layer that are formed on the surface of a fuel adsorbent.

The effect (b) will be described. When alkane, olefin, and the like contained in the evaporated fuel are adsorbed to the fuel adsorbent 41*a*, a mono-molecular layer is formed on the surface of the fuel adsorbent 41*a* by chemical adsorption. The mono-molecular layer formed on the surface of the fuel adsorbent 41*a* is schematically shown on the left side of FIG. 2.

On the other hand, alcohol generated by the reforming is adsorbed on the surface of the fuel adsorbent 41*a* by chemical adsorption and alcohol molecules are physically adsorbed to each other according to an increase in van der Waals force to form a multi-molecular layer. The multi-molecular layer formed on the surface of the fuel adsorbent 41*a* is schematically shown on the right side of FIG. 2.

When the concentration of the "substance (in this example, alcohol) forming the multi-molecular layer at the time of adsorption to the fuel adsorbent 41*a*" in the evaporated fuel flowing into the canister 41 increases, the number of molecules that can be adsorbed per unit surface area of the fuel adsorbent 41*a* increases. Therefore, the capture upper limit amount of the canister 41 increases due to the reforming into alcohol.

The effect (c) will be described. The multi-molecular layer formed on the surface of the fuel adsorbent 41*a* by the physical adsorption is easily desorbed by an air current (that is, a purge air current) that is generated in the canister 41 during the execution of the purge processing, compared to the mono-molecular layer formed by chemical adsorption. For this reason, when the concentration of the "substance forming the multi-molecular layer at the time of adsorption to the fuel adsorbent 41*a*" in the evaporated fuel flowing into the canister 41 increases, desorption of the fuel captured in the canister 41 becomes easy.

As described above, with the evaporated fuel treating device, a possibility that the excessive evaporated fuel emission phenomenon may occur can be reduced due to the reforming of the evaporated fuel into alcohol by the reforming catalyst 48. For example, in order to increase the capture upper limit amount of the canister (eventually, in order to further reduce a possibility that the excessive evaporated fuel emission phenomenon may occur), an increase in the size of the canister (including the fuel adsorbent contained in the canister) and heating of the fuel adsorbent by a heating wire are conceivable. However, in a case where the size of the canister increases, there is a possibility that it may become difficult to secure an installation place in a vehicle. In a case where the fuel adsorbent is heated by a heating wire, there is a possibility that the fuel consumption rate (fuel efficiency) of a vehicle may deteriorate due to energy consumption for the heating. On the other hand, with the evaporated fuel treating device, it becomes possible to further reduce a possibility that the excessive evaporated fuel emission phenomenon may occur, without an increase in the size of the canister and deterioration of the fuel consumption rate of a vehicle.

First Modification Example of Embodiment

Figure 3:
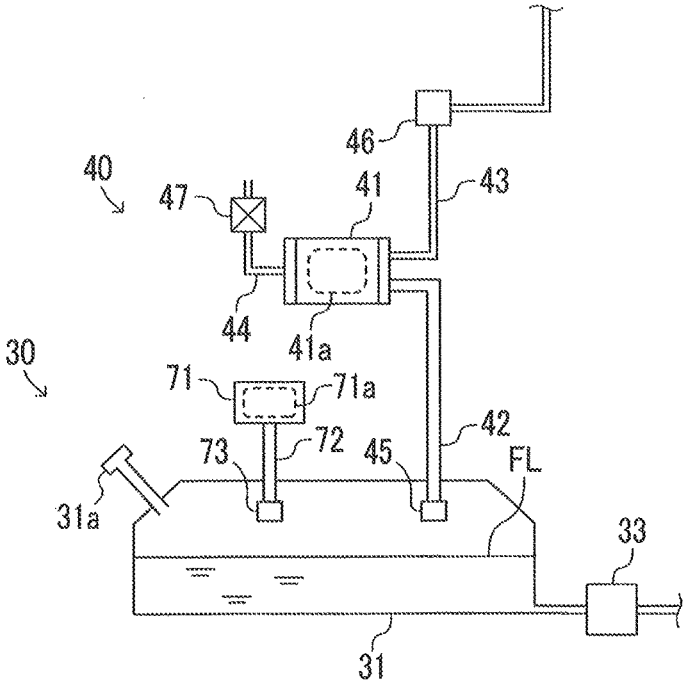
FIG. 3 is a schematic diagram of an evaporated fuel treating device according to a first modification example of the embodiment.

A first modification example of the embodiment of the evaporated fuel treating device will be described. The configuration of an evaporated fuel treating device according to the first modification example of the embodiment is shown in FIG. 3. The reforming catalyst 48 according to the embodiment of the disclosure described above is disposed on the inner upper surface of the fuel tank 31. In contrast, a reforming catalyst 71*a* according to the first modification example of the embodiment is contained in a reforming chamber 71 that is outside the fuel tank 31. Hereinafter, description will be made with a focus on the difference between the embodiment of the disclosure and the first modification example of the embodiment.

The fuel tank 31 and the reforming chamber 71 communicate with each other through a reforming pipe 72. A reforming cutoff valve 73 is disposed at a protrusion portion in the fuel tank 31, which is one end of the reforming pipe 72. More specifically, the reforming cutoff valve 73 is disposed at an upper portion of the fuel tank 31 and at a location where the fuel FL does not reach when the present vehicle is stationary. The reforming cutoff valve 73 includes a float valve and allows gas flow while hindering liquid flow. For this reason, the evaporated fuel can pass through the reforming cutoff valve 73. However, inflow of the fuel FL from the fuel tank 31 to the reforming chamber 71 is blocked by the reforming cutoff valve 73.

Some of the evaporated fuel in the fuel tank 31 flows into the reforming chamber 71 through the reforming pipe 72 and is reformed into alcohol by the reforming catalyst 71*a*. Some of alcohol of gas generated by the reforming flows into the fuel tank 31 through the reforming pipe 72.

On the other hand, the inflow of the fuel FL to the reforming chamber 71 is blocked by the reforming cutoff valve 73, and therefore, reforming of the fuel FL into alcohol due to the direct contact of the fuel FL with the reforming catalyst 71*a* is avoided. Therefore, with the evaporated fuel treating device of the first modification example of the embodiment, the concentration of alcohol in the fuel FL is inhibited from becoming higher than needed (specifically, the concentration of alcohol in the fuel FL is inhibited from becoming higher than the concentration of alcohol to the extent that the effect (a) is obtained). For this reason, the decrease amount of the "amount of heat that is generated when the fuel FL burns in the combustion chamber 22" is avoided from becoming excessive due to the fact that the concentration of "alcohol in which the amount of generated heat at the time of combustion is further reduced due to reforming" in the fuel FL becomes higher than needed.

Second Modification Example of Embodiment

Figure 4:
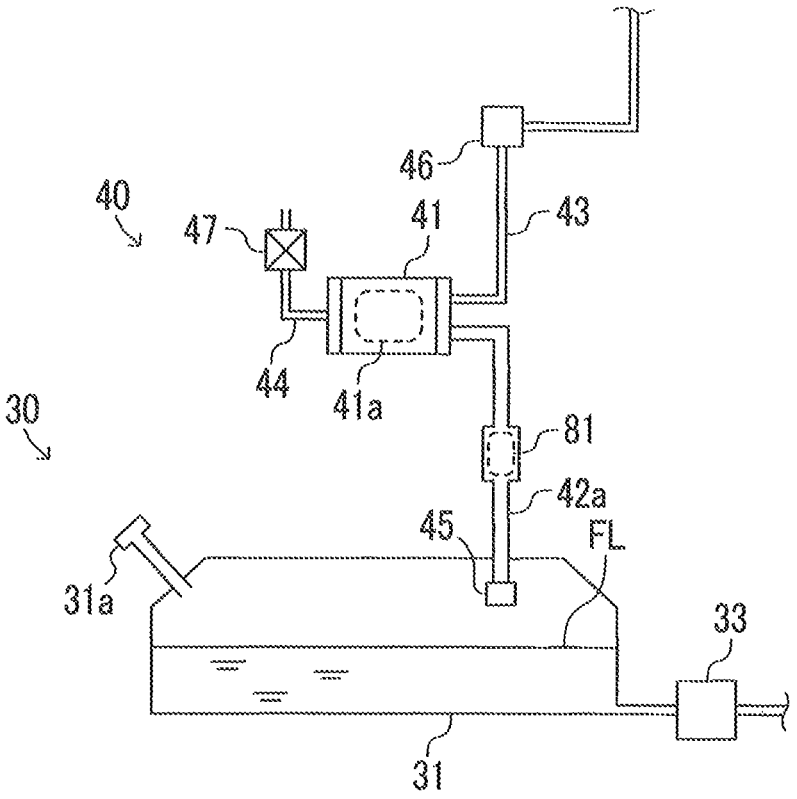
FIG. 4 is a schematic diagram of an evaporated fuel treating device according to a second modification example of the embodiment.

A second modification example of the embodiment of the evaporated fuel treating device will be described. The configuration of an evaporated fuel treating device according to the second modification example of the embodiment is shown in FIG. 4. The reforming catalyst 48 according to the embodiment of the disclosure described above is disposed on the inner upper surface of the fuel tank 31. In contrast, a reforming catalyst 81 according to the second modification example of the embodiment is contained (interposed) in a vent pipe 42*a* that makes the fuel tank 31 communicate with the canister 41. Hereinafter, description will be made with a focus on the difference between the embodiment of the disclosure and the second modification example of the embodiment.

Some of the evaporated fuel in the fuel tank 31 flows into the vent pipe 42*a* and is reformed into alcohol by the reforming catalyst 81. Some of alcohol of gas generated by the reforming flows into the fuel tank 31.

On the other hand, the inflow of the fuel FL to the vent pipe 42*a* is blocked by the cutoff valve 45, and therefore, reforming of the fuel FL into alcohol due to the direct contact of the fuel FL with the reforming catalyst 81 is avoided. Therefore, with the evaporated fuel treating device of the second modification example of the embodiment, the decrease amount of the "amount of heat that is generated when the fuel FL burns in the combustion chamber 22" is avoided from becoming excessive due to the fact that the concentration of alcohol in the fuel FL becomes higher than needed.

The evaporated fuel treating device according to the embodiment and the modification examples of the disclosure has been described above. However, the disclosure is not limited to the embodiment of the disclosure and the modification examples described above, and various modifications can be made without departing from the object of the disclosure. For example, the present vehicle according to the embodiment of the disclosure is a hybrid vehicle. However, the engine 10 may be mounted on a vehicle that is not provided with an electric motor as a drive power source. Further, the engine 10 may be mounted on a vehicle having a start-stop function. Alternatively, the engine 10 may be an engine that is provided with a supercharger, or an engine adopting the Atkinson cycle.

The fuel adsorbent 41*a* according to the embodiment of the disclosure is composed of activated carbon. However, the fuel adsorbent 41*a* may be composed of a material (for example, a material capable of adsorbing evaporated fuel into pores; as an example, zeolite) other than activated carbon.

The reforming catalyst 48 according to the embodiment of the disclosure includes mesoporous silica as a carrier, and platinum supported on the carrier. However, the carrier of the reforming catalyst 48 may be a substance (for example, aluminum oxide, silicon dioxide, zirconia, or titanium oxide) other than mesoporous silica. Further, the substance that is supported on the carrier of the reforming catalyst 48 may be any substance that promotes the chemical change from unsaturated hydrocarbon to alcohol and therefore, may be a substance (for example, palladium, gold, or silver) other than platinum.

A vent valve that is opened when the "pressure in the fuel tank 31" becomes higher than the "pressure in the canister 41" by a predetermined pressure threshold value because some of the fuel FL evaporates to generate evaporated fuel may be interposed in each of the vent pipe 42 and the vent pipe 42*a*.

In particular, in the evaporated fuel treating device according to the second modification example of the embodiment, the vent valve may be interposed at a position between the reforming catalyst 81 and the canister 41 side in the vent pipe 42*a*. In this case, compared to a case where the vent valve is not provided, a time after the pressure in the fuel tank 31 starts to rise due to generation of the evaporated fuel and until the evaporated fuel flows into the canister 41 is delayed. As a result, the amount of alcohol that is produced in the reforming catalyst 81 increases. Therefore, according to this configuration described above, a sufficient amount of alcohol is produced in order to obtain the effects (a) to (c) described above.

The purge processing execution condition according to the embodiment of the disclosure is satisfied when both of Condition 1 and Condition 2 are satisfied. However, the purge processing execution condition may be different from Condition 1 and Condition 2. For example, Condition 1 may be omitted. In this case, when Condition 2 is satisfied, the purge processing execution condition is satisfied. Alternatively, the purge processing execution condition may be a condition that is satisfied when the operation time of the engine 10, which has elapsed after the purge processing is last executed, exceeds a predetermined time threshold value.

What is claimed is:

1. An evaporated fuel treating device comprising:

a fuel tank that stores fuel, in a liquid state, to be supplied to an internal combustion engine;

a canister containing a fuel adsorbent, the fuel adsorbent being configured to capture evaporated fuel that is generated due to vaporization of the fuel stored in the fuel tank;

a vent pipe in which the evaporated fuel in the fuel tank flows into the canister;

a purge pipe in which the fuel captured in the canister flows into an intake passage of the internal combustion engine;

a purge valve interposed in the purge pipe and the purge valve being configured to open when the captured fuel is introduced into the intake passage; and a reforming catalyst disposed in a space in which the reforming catalyst comes into contact with the evaporated fuel that is generated in the fuel tank and that has not reached the canister, the reforming catalyst being configured to promote a chemical change from unsaturated hydrocarbon contained in the evaporated fuel to alcohol.

2. The evaporated fuel treating device according to claim 1, wherein:

the reforming catalyst is disposed in the space isolated from the fuel stored in the fuel tank by a cutoff valve, and the cutoff valve is configured to block a flow of liquid and allow a flow of gas.

3. An evaporated fuel treating device comprising:

a fuel tank that stores fuel, in a liquid state, to be supplied to an internal combustion engine;

a canister containing a fuel adsorbent, the fuel adsorbent being configured to capture evaporated fuel that is generated due to vaporization of the fuel stored in the fuel tank;

a vent pipe in which the evaporated fuel in the fuel tank flows into the canister;

a purge pipe in which the fuel captured in the canister flows into an intake passage of the internal combustion engine;

a purge valve interposed in the purge pipe and the purge valve being configured to open when the captured fuel is introduced into the intake passage; and a reforming catalyst disposed within the fuel tank such that the reforming catalyst comes into contact with the evaporated fuel that is generated in the fuel tank and that has not reached the canister, the reforming catalyst being configured to promote a chemical change from unsaturated hydrocarbon contained in the evaporated fuel to alcohol.

* * * * *